US010518843B1

(12) United States Patent
Melvin et al.

(10) Patent No.: US 10,518,843 B1
(45) Date of Patent: Dec. 31, 2019

(54) PLANING HULL CATAMARAN FOR HIGH SPEED OPERATION IN A SEAWAY

(71) Applicant: Morrelli & Melvin Design & Engineering, Inc., Newport Beach, CA (US)

(72) Inventors: Pete Melvin, Huntington Beach, CA (US); Andrew Bloxom, Newport Beach, CA (US); Mark Peters, Newport Beach, CA (US)

(73) Assignee: Morrelli & Melvin Design & Engineering, Inc., Newport Beach, CA (US)

( * ) Notice: Subject to any disclaimer, the term of this patent is extended or adjusted under 35 U.S.C. 154(b) by 0 days.

(21) Appl. No.: 16/156,549

(22) Filed: Oct. 10, 2018

Related U.S. Application Data

(60) Provisional application No. 62/570,257, filed on Oct. 10, 2017.

(51) Int. Cl.
*B63B 1/20* (2006.01)
*B63B 1/24* (2006.01)
*B63B 3/62* (2006.01)

(52) U.S. Cl.
CPC ..... *B63B 1/20* (2013.01); *B63B 1/242* (2013.01); *B63B 3/62* (2013.01); *B63B 2001/203* (2013.01)

(58) Field of Classification Search
CPC .. B63B 1/00; B63B 1/04; B63B 1/042; B63B 1/12; B63B 1/121; B63B 1/16; B63B 1/20; B63B 1/24; B63B 1/26; B63B 1/38
USPC ..... 114/61.1, 61.2, 271, 274, 283, 291, 292
See application file for complete search history.

(56) References Cited

U.S. PATENT DOCUMENTS

| | | | | |
|---|---|---|---|---|
| 3,726,246 | A | 4/1973 | Wukowitz | |
| 4,031,841 | A | 6/1977 | Bredt | |
| 4,091,761 | A * | 5/1978 | Fehn | B63B 1/042 114/271 |
| 4,348,195 | A | 9/1982 | Lantz | |
| 4,606,291 | A | 8/1986 | Hoppe | |
| 4,649,851 | A * | 3/1987 | April | B63B 1/06 114/271 |
| 4,748,929 | A | 6/1988 | Payne | |
| 4,802,428 | A * | 2/1989 | Lang | B63B 1/12 114/283 |
| 4,989,534 | A | 2/1991 | Field | |
| 5,038,696 | A | 8/1991 | Athanasiou et al. | |
| 5,140,930 | A * | 8/1992 | Lund | B63B 1/20 114/291 |

(Continued)

*Primary Examiner* — Lars A Olson
(74) *Attorney, Agent, or Firm* — Christopher H. Ramsey; GrayRobinson, P.A.

(57) ABSTRACT

A boat hull includes a pair of demi-hulls. Each demi-hull has a running surface configured to contact water when the hull is planing. The running surface extends longitudinally along a keel between an outer chine and an inner chine and aft to a running surface trailing edge. The running surface has most of its surface area outboard the keel. A first step extends laterally across the running surface and between the outer chine and inner chine. A first planing surface is aft the first step along the running surface. The first planing surface has an outboard convex curved surface on an outboard side of the keel extending from the keel to the outer chine and an inboard convex curved surface on an inboard side of the keel extending from the keel to the inner chine.

19 Claims, 11 Drawing Sheets
(1 of 11 Drawing Sheet(s) Filed in Color)

(56) References Cited

U.S. PATENT DOCUMENTS

| | | | | |
|---|---|---|---|---|
| 5,191,853 | A | 3/1993 | Adler | |
| 5,526,762 | A | 6/1996 | Kiley | |
| 5,570,650 | A * | 11/1996 | Harley | B63B 1/12 114/61.2 |
| 6,148,757 | A | 11/2000 | Schulte | |
| 6,425,341 | B1 | 7/2002 | Devin | |
| 6,666,160 | B1 | 12/2003 | Örneblad | |
| 6,675,736 | B1 | 1/2004 | Schreiber et al. | |
| 7,497,179 | B2 * | 3/2009 | Dize | B63B 1/121 114/271 |
| 8,291,850 | B1 | 10/2012 | Peters | |
| 8,701,583 | B2 | 4/2014 | Boschoff et al. | |
| 8,915,206 | B1 | 12/2014 | Herrington et al. | |
| 9,162,732 | B2 | 10/2015 | Torres et al. | |

* cited by examiner

SYMMETRIC

ASYMMETRIC

SEMI-ASYMMETRIC
UNEQUAL CHINE HEIGHT, EQUAL DEADRISE

SEMI-ASYMMETRIC
EQUAL CHINE HEIGHT, UNEQUAL DEADRISE

PLANING HULL CATAMARAN FOR HIGH SPEED OPERATION IN A SEAWAY

CROSS-REFERENCE TO RELATED APPLICATION

The claims priority to U.S. provisional Application No. 62/570,257, filed Oct. 10, 2017, which is incorporated by reference in its entirety.

FIELD

This relates to the field of boats and, more particularly, to the design of powered catamaran hulls.

BACKGROUND

Powered catamarans that have high-speed planning capability have been developed. Planing occurs when the catamaran is moving fast enough to achieve sufficient hydrodynamic lift to cause the vessel to rise vertically and the underside of the hull to skim along the surface of the water, rather than be supported by Archimedean buoyancy. Several hydrodynamic factors affect planing. These factors include the interplay between lift and drag, the shape of the hull's planning surfaces, and the aspect ratio of the hull.

SUMMARY

In view of the foregoing, it would be advantageous to have a powered catamaran hull designed for high-speed operation in the presence of waves as one might experience offshore in the ocean or inshore on windy days. Such a powered catamaran hull is described herein.

A first example of such a boat hull includes a pair of demi-hulls. Each demi-hull has a running surface configured to contact water when the hull is planing. The running surface extends longitudinally along a keel between an outer chine and an inner chine and aft to a running surface trailing edge. The running surface has 55% to 80% of its surface area outboard the keel. A first step extends laterally across the running surface and between the outer chine and inner chine. A first planing surface is aft the first step along the running surface. The first planing surface has an outboard convex curved surface on an outboard side of the keel extending from the keel to the outer chine and an inboard convex curved surface on an inboard side of the keel extending from the keel to the inner chine.

Additional features of this first example may include any of the following features.

The first step may be positioned 38% to 46% of a distance forward the running surface trailing edge and a point where a hydrostatic waterline of the demi-hull intersects a bow end of the demi-hull measured along a ¼ buttock line of the demi-hull.

The depth of the first step may be 2% to 6% of a beam of the demi-hull.

The first planing surface may be strakeless.

The boat hull may further include (a) a second step aft the first planing surface that extends laterally across the running surface and between the outer chine and inner chine and (b) a second planing surface aft the second step along the running surface. The second planing surface has an outboard convex curved surface on an outboard side of the keel extending from the keel to the outer chine and an inboard convex curved surface on an inboard side of the keel extending from the keel to the inner chine.

The second step may be positioned 18% to 27% of a distance forward the running surface trailing edge and a point where a hydrostatic waterline of the demi-hull intersects a bow end of the demi-hull measure along a ¼ buttock line of the demi-hull.

The depth of the second step may be 1% to 5% of a beam of the demi-hull.

The second planing surface may be strakeless.

The demi-hull may have an unequal chine height and a substantially equal deadrise angle on either side of the keel.

A hydrofoil may be positioned between the pair of demi-hulls.

The boat hull may be on a boat including a boat drive mechanism.

A second example of the boat hull includes a pair of demi-hulls, the demi-hulls respectively having a running surface configured to contact water when the hull is planing. The running surface extends longitudinally along a keel between an outer chine and an inner chine. The running surface has an aft terminal edge and an intersection point where a hydrostatic waterline of the demi-hull intersects a bow section of the demi-hull. A first step extends laterally across the running surface and between the outer chine and inner chine. The first step is positioned 38% to 46% of a distance forward the aft terminal edge and the intersection point measured along a ¼ buttock line of the demi-hull. A second step extends laterally across the running surface and between the outer chine and inner chine. The second step is positioned 18% to 27% of the distance forward the aft terminal edge and the intersection point measured along the ¼ buttock line of the demi-hull.

Additional features of this second example may include any of the following features.

The running surface may have 55% to 80% of its surface area outboard the keel.

The boat hull may further include a first planing surface aft the first step along the running surface, the first planing surface having an outboard convex curved surface on an outboard side of the keel extending from the keel to the outer chine and an inboard convex curved surface on an inboard side of the keel extending from the keel to the inner chine. The boat hull may also include a second planing surface aft the first step along the running surface, the second planing surface having an outboard convex curved surface on an outboard side of the keel extending from the keel to the outer chine and an inboard convex curved surface on an inboard side of the keel extending from the keel to the inner chine.

The first planing surface may be strakeless and the second planing surface may be strakeless.

The demi-hull may have an unequal chine height and substantially equal deadrise angle on either side of the keel.

A depth of the first step may be 2% to 6% of a beam of the demi-hull and a depth of the second step may be 1% to 5% of a beam of the demi-hull.

A hydrofoil may be positioned between the pair of demi-hulls.

The boat hull may be on a boat including a boat drive mechanism.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF EXAMPLE EMBODIMENTS

This disclosure describes example aspects and embodiments, but not all possible aspects embodiments of the planing catamaran hull. Where a particular feature is disclosed in the context of a particular aspect or embodiment, that feature can also be used, to the extent possible, in combination with and/or in the context of other aspects and embodiments. The planing catamaran hull may be embodied in many different forms and should not be construed as limited to only the embodiments described here.

For reference, different types of conventional catamaran demi-hull geometries are first described with reference to FIGS. 1-4. In FIGS. 1-4, the vertical dashed line indicates the position of the keel line. The keel line is a curve along the hull bottom defined by the intersection of the demi-hull and a vertical plane oriented in the longitudinal direction and passing through the forward most extent of each demi-hull, or stem. The hull geometries are represented by a cross-section taken amidships of the specified hull.

Figure 1:
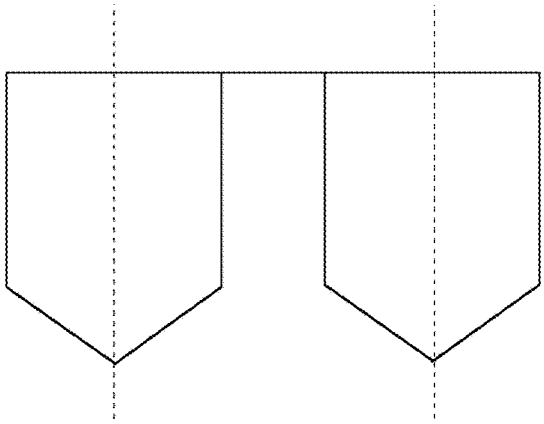
FIG. 1 is a diagram of the geometry of a conventional catamaran with symmetric demi-hulls amidships.

FIG. 1 shows a symmetric catamaran hull geometry. The symmetric catamaran hull geometry has equal proportions of immersed cross sectional area inboard and outboard of the demi-hull keel line with equal chine height and equal deadrise.

Catamarans with symmetric demi-hulls make for good all-around boats at Volume Froude Numbers (FNV) in the 2.5 to 4.5 range. Approximately half of the water flow displaced around each demi-hull keel line is deflected inward, partially or fully filling the tunnel with a mix of solid water, and aerated water due to spray. This mixed air/water flow creates a higher than atmospheric pressure condition in the tunnel, especially as the catamaran is experiencing vertical decelerations due to wave encounters. The pressure increase has the effect of dampening vertical accelerations and making for a more comfortable ride for passengers, and reducing structural loads. Resistance of symmetric demi-hull catamarans compares most favorably with other types of catamaran hulls at FNV below about 4. Symmetric demi-hull catamarans tend to roll towards the outside of a turn, which can be destabilizing and less safe for passengers.

Figure 2:
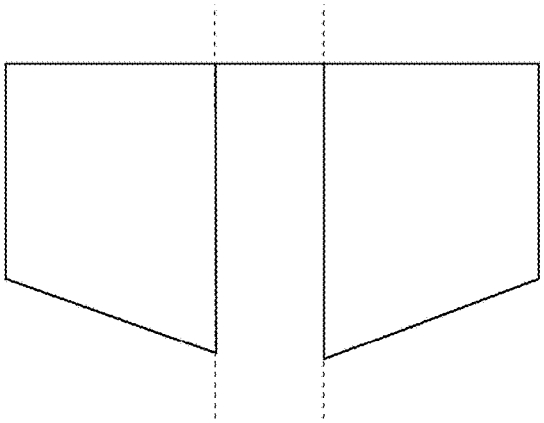
FIG. 2 is a diagram of the geometry of a conventional catamaran with asymmetric demi-hulls amidships.

FIG. 2 shows an asymmetric catamaran hull geometry. The asymmetric catamaran hull geometry has a major proportion of its immersed cross sectional area outboard (90-100%) of the keel line, and a vertical inner sidewall defining the tunnel and outboard chine on each demi-hull.

Asymmetric demi-hull catamarans are used on boats that are capable of FNV above about 7. Resistance at high FNV is reduced at least partially due to aerodynamic lift being created by the flow of air through the tunnel. At low FNV's the aerodynamic benefits are small or non-existent if the tunnel is low and blocked off by solid water. Most of the water displaced at speed is deflected to the outside of each demi-hull keel line and there is significantly less air/water mixing than with symmetric demi-hull catamarans.

In order to optimize the aerodynamics of an asymmetric demi-hull catamaran for high speed, the tunnel height at the transom is typically designed to be very close or in the water at rest. Catamarans operating at low and medium speeds offshore are typically designed with greater clearance between the tunnel and water surface to reduce wave impacts.

Asymmetric demi-hull catamarans tend to turn flat or roll slightly inboard in a high speed turn, but can roll outwards in lower speed turns. Since the centers of buoyancy of each demi-hull are further toward the centerline of the catamaran, asymmetric demi-hull catamarans tend to be less stable in roll while at rest or while moving at low speeds than symmetric demi-hull catamarans. Asymmetric demi-hull catamarans can also exhibit broaching tendencies (yaw instabilities) in some sea states, due to the asymmetric flow around of each demi-hull when penetrating into the back of waves.

Figure 3:
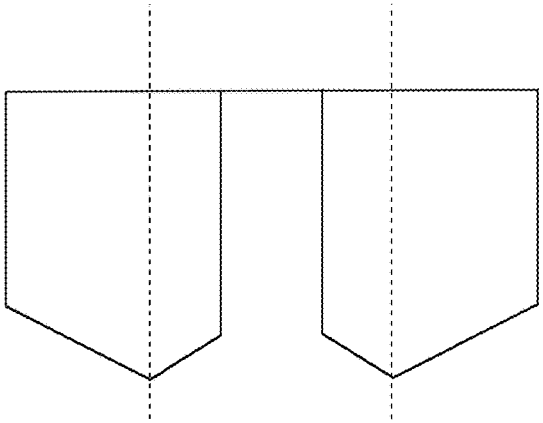
FIG. 3 is a diagram of the geometry of a conventional catamaran with semi-asymmetric demi-hulls amidships with unequal chine heights and equal deadrise.
Figure 4:
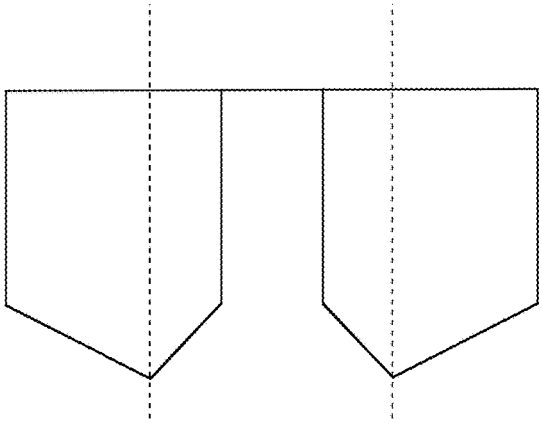
FIG. 4 is a diagram of the geometry of a conventional catamaran with semi-asymmetric demi-hulls amidships with equal chine heights and unequal deadrise.
Figure 5:
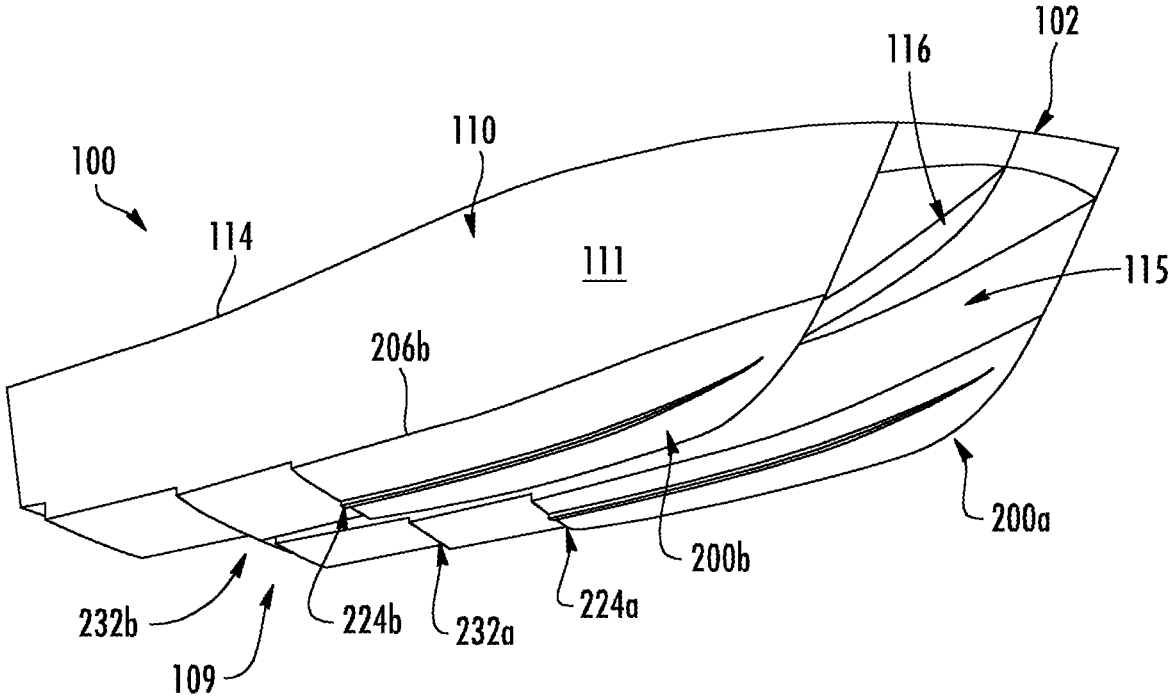
FIG. 5 is a bottom front perspective view of an example of the planing catamaran hull.
Figure 6:
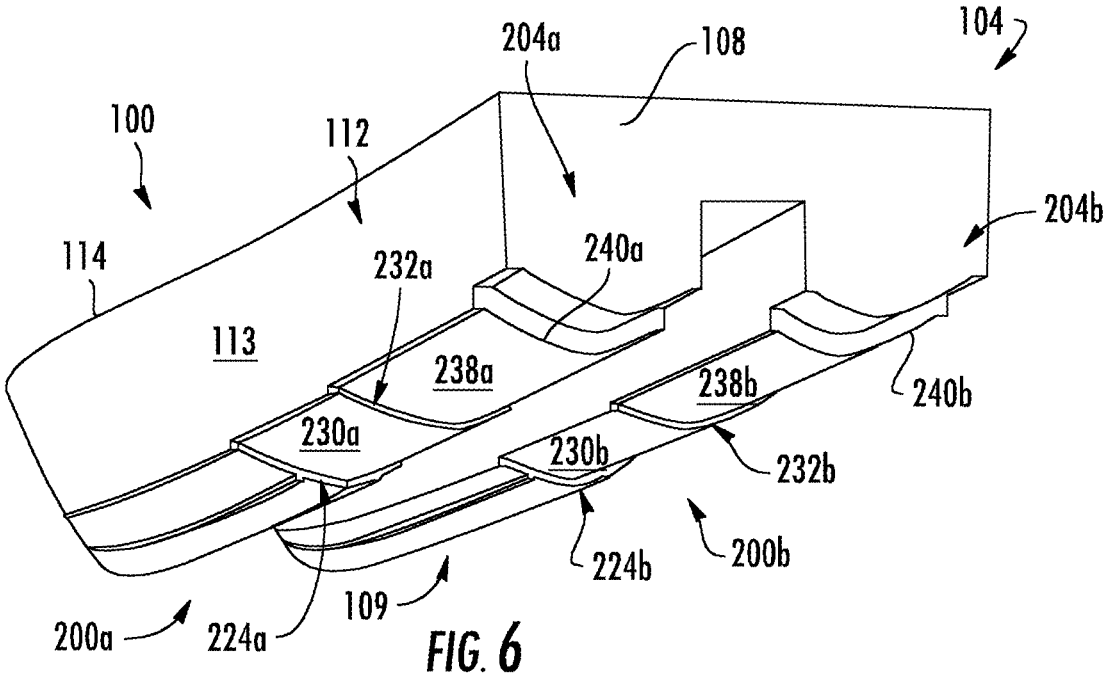
FIG. 6 is a bottom rear perspective view thereof.
Figure 7:
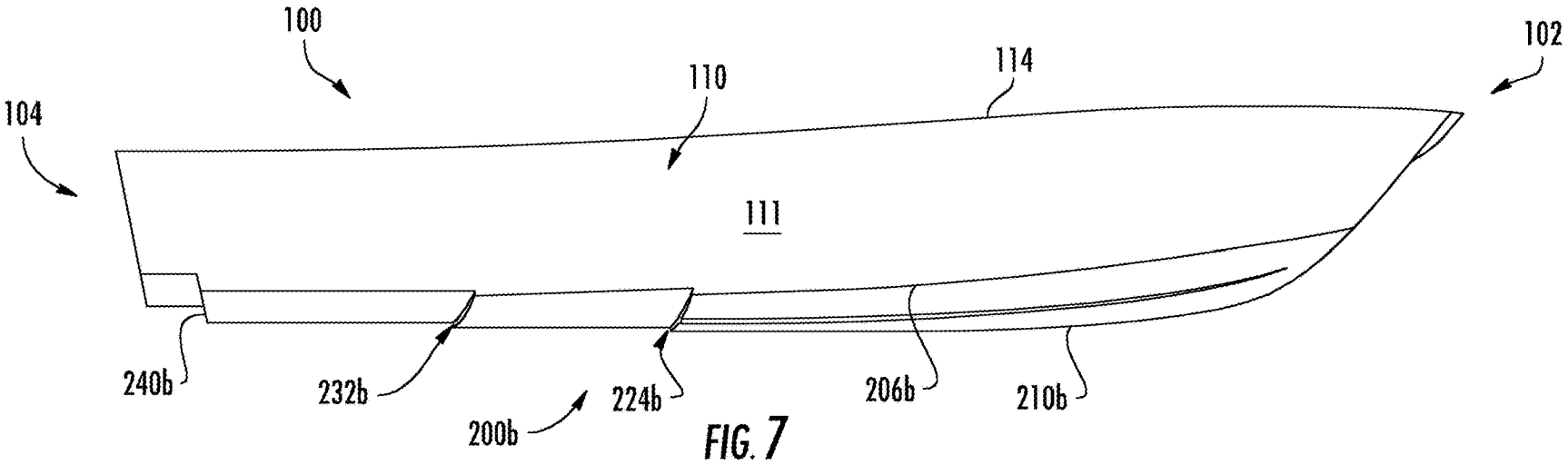
FIG. 7 is starboard side plan view thereof.
Figure 8:
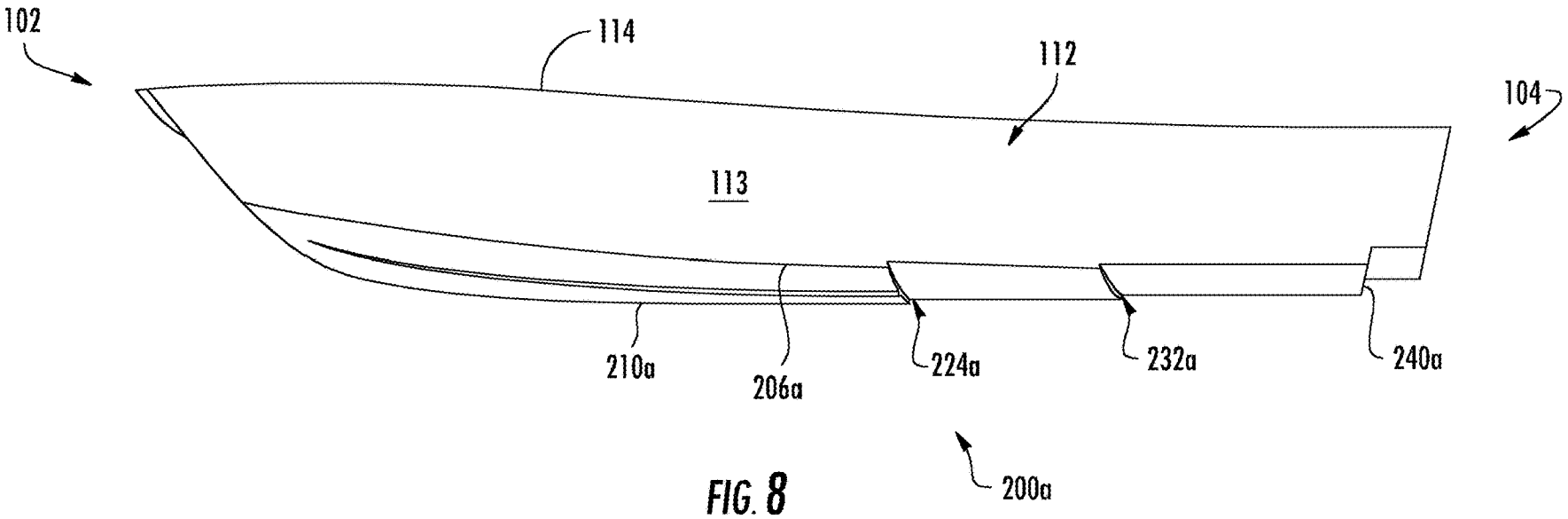
FIG. 8 is a port side plan view thereof.
Figure 9:
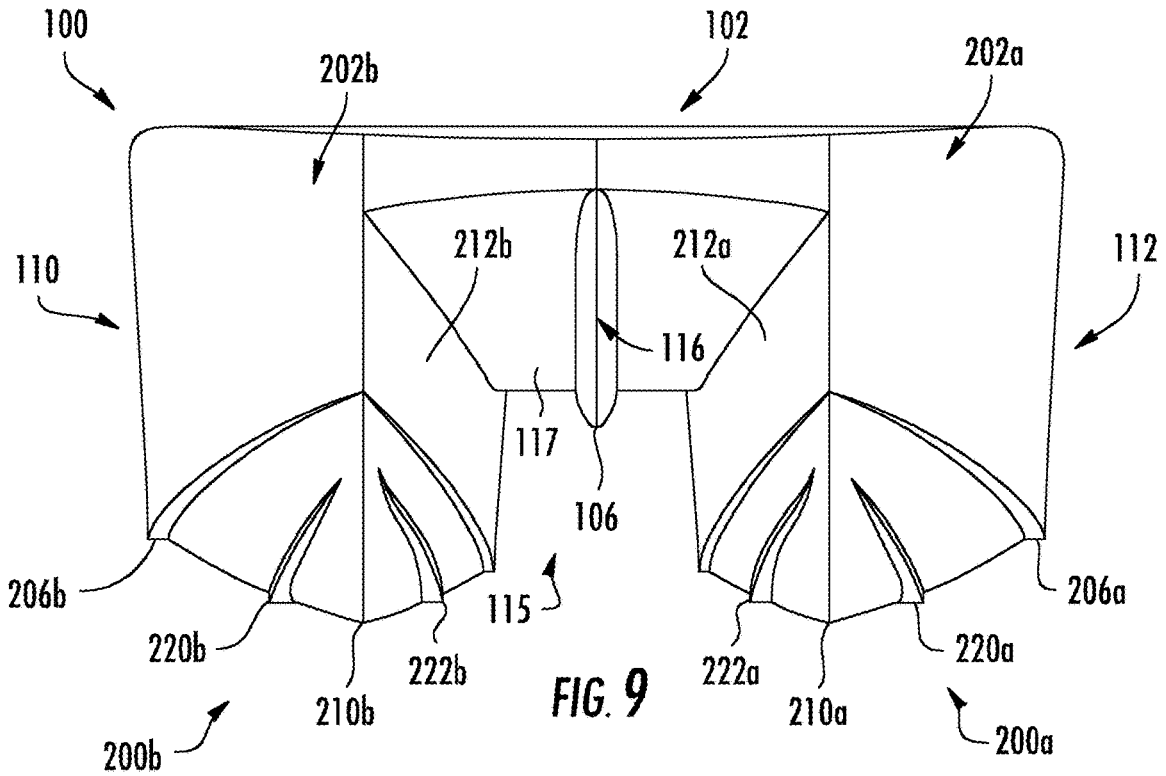
FIG. 9 is a front side plan view thereof.
Figure 10:
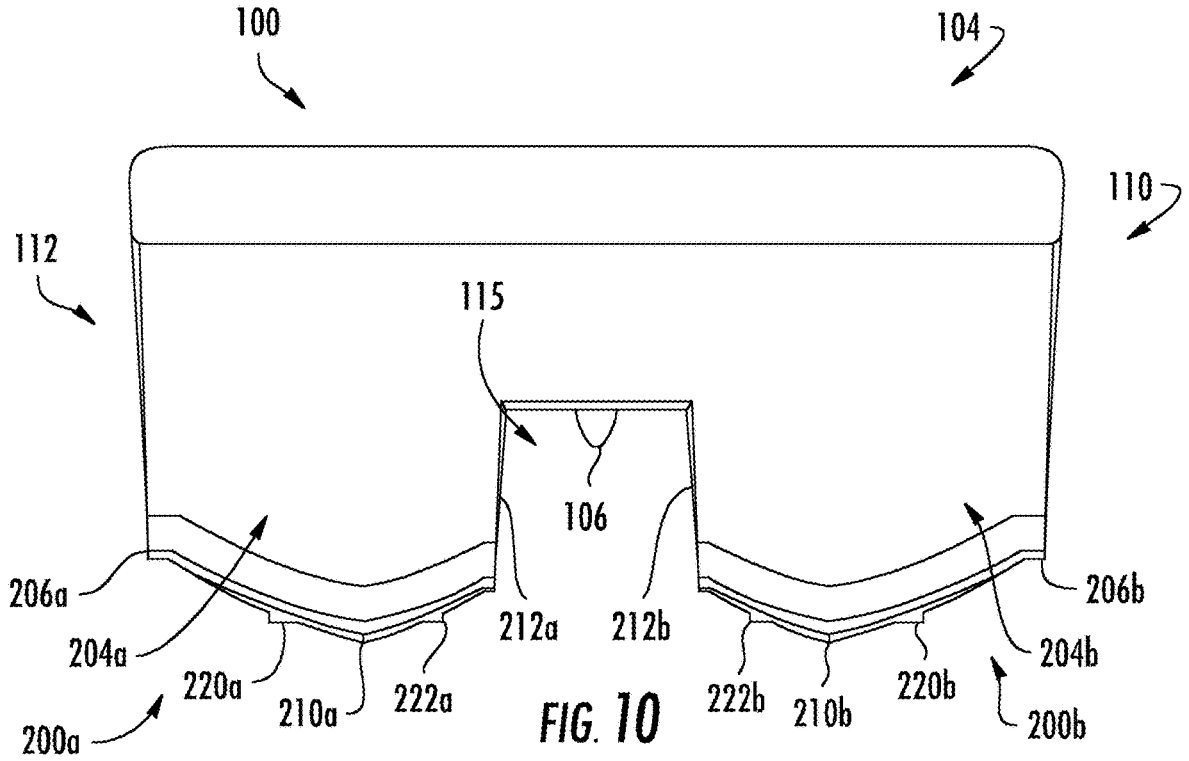
FIG. 10 is a rear side plan view thereof.

FIGS. 3 and 4 show two different examples of semi-asymmetric catamaran hull geometries. Semi-asymmetric catamaran hull geometries have a greater proportion of immersed cross sectional area outboard (55-90%) of the demi-hull keel line than inboard (10-45%). The example in FIG. 3 has unequal chine height and equal deadrise. The example in FIG. 4 has equal chine height and unequal deadrise.

Semi-asymmetric demi-hull catamarans can be incorporated to optimize the resistance, handling, and seakeeping characteristics of planing catamarans. Semi-asymmetric demi-hull catamarans exhibit low resistance in the FNV 4-7 range, and can have improved ride and handling characteristics compared to the symmetric and asymmetric geometries. Many small craft powered vessels operate in the FNV 4-7 range.

On semi-asymmetric demi-hull catamarans, the majority of the displaced hull volume lies outboard of each demi-hull keel line, but retains a functional percentage of volume inboard of each demi-hull keel line, typically on the order of 25% to 40%. Semi-asymmetric demi-hull catamarans tend to roll into turns, improving stability and passenger safety. They are more stable at rest and at low speeds than asymmetric demi-hull catamarans due to the centers of hull volume being further outboard. Semi-asymmetric demi-hull catamarans can be designed to operate efficiently with high tunnels, reducing resistance and wave impact at slow speeds. Semi-asymmetric demi-hull catamarans also exhibit good seakeeping in following seas with little tendency to broach.

Certain examples of the planing hull catamaran described here are adapted for powered high-speed operation in wave-prone water bodies such as the ocean, large lakes, and the like. The hull is designed to provide a smooth, dry ride in the type of rough water conditions one might experience offshore in the ocean, while at the same time experiencing less drag to achieve faster speeds when planing than conventional powered catamarans. The decreased drag may also increase fuel efficiency.

An example of the planing hull catamaran will now be described with reference to FIGS. 5-11. This disclosure describes example aspects and embodiments, but not all possible aspects embodiments of the planing catamaran hull. Where a particular feature is disclosed in the context of a particular aspect or embodiment, that feature can also be used, to the extent possible, in combination with and/or in the context of other aspects and embodiments. The planing catamaran hull may be embodied in many different forms and should not be construed as limited to only the embodiments described here.

The catamaran hull 100 extends longitudinally from a bow 102 to a stern 104 along a hull centerline 106 that runs longitudinally along the center of the hull 100, dividing the hull 100 in half. A transom 108 is positioned at the stern end of the hull 100. The transom 108 intersects a hull underside 109 and extends vertically from the hull underside 109, forming an aftmost section of the hull 100.

The hull 100 extends laterally from a starboard side 110 having a starboard sidewall 111 to a port side 112 having a port sidewall 113. The respective sidewalls 111, 113 extend vertically from the hull underside 109 to a gunwale 114 circumscribing the hull 100. A tunnel 115 extends between demi-hulls 200*a,b* along the hull centerline 106. A wave splitter 116 is positioned within the tunnel 115 and extends aft from the bow 102.

The wave splitter 116 protrudes outwardly into the tunnel 115 emulating the shape of a V along a curved portion of the hull 100 extending aft the bow 102. The wave splitter is configured to soften the impact of waves against the upper wall 117 of the tunnel 115, to provide a smoother ride.

The demi-hulls 200*a,b* are now described. Because both demi-hulls are substantially the same, the letters a and b are used to represent the two demi-hulls and their respective features. The letter a refers to the features of one of the demi-hulls and the letter b refers to the corresponding features of the other demi-hull.

The demi-hulls 200*a,b* extend from a demi-hull bow 202*a,b* longitudinally to a demi-hull stern 204*a,b* and laterally from an outer chine 206*a,b* to a tunnel wall 212*a,b*. An inner chine 208*a,b* intersects the underside 109 and the tunnel wall 212*a,b*.

A forward section 214 of each demi-hull 200*a,b* aft the demi-hull bow 202*a,b* is a V-shaped. The V shape allows the demi-hull bows 202 to cut through rough water and waves when moving forward. Aft the forward section 214, is an amidships section 216. Aft the amidships section 216 is an aft section 218. The features of the demi-hulls 200*a,b* moving aft through the amidships section 216 and aft section 216 give the hull 100 some advantageous functions.

The underside 109 of each demi-hull 202*a,b* defines the running surface of the hull 100. The running surface is the portion of the hull 100 that is in contact with water as the hull moves forward in the planing regime.

Each demi-hull is semi-asymmetric, having 55% to 80% of its surface area outboard the keel 210*a,b* and 20% to 45% of its surface area inboard the keel 210*a,b*.

A first spray rail 220*a,b* and a second spray rail 222*a,b* extend longitudinally aft from the demi-hull bow 202*a,b* on either side of the keel 210*a,b*. These spray rails 220*a,b* may also function as lifting stakes, providing lift when the hull 100 is moving forward and dispersing spray laterally for a drier ride. The number of spray rails can vary among different examples.

Each demi-hull 200*a,b* includes at least one transverse step extending laterally across the underside 109 of the demi-hull 200*a,b* from the outer chine 206*a,b* to the inner chine 208*a,b*. The example shown includes a pair of transverse steps, but other examples may include only one step or more than one step.

A first step 224*a,b* extends laterally across the demi-hull 200*a,b* from the outer chine 206*a,b* to the inner chine 208*a,b*. The first step 224*a,b* includes a forward edge 226*a,b* and a vertical step wall 228*a,b*. A first planing surface 230*a,b* is vertically offset from the forward edge 226*a,b*.

A second step 232*a,b* extends laterally across the demi-hull 200*a,b* from the outer chine 206*a,b* to the inner chine 208*a,b* aft the first planing surface 230*a,b*. The second step 232*a,b* includes a second step forward edge 234*a,b* and a vertical first step wall 236*a,b*. A second planing surface 238*a,b* is vertically offset from the second step forward edge 234*a,b*. The second planing surface 238*a,b* extends aft and terminates at a running surface trailing edge 240*a,b*.

Steps 220*a,b* and 232*a,b* may optionally bisect the respective demi-hull 200*a,b* in such a way that the step forward edges 226*a,b* and 234*a,b* are swept forward to emulate the shape of a V with the vertex of the V shape aft the arms of the V shape. Such a swept forward shape may help ventilate planing surfaces 230*a,b* and 238*a,b* when the boat is moving forward.

Figure 13:
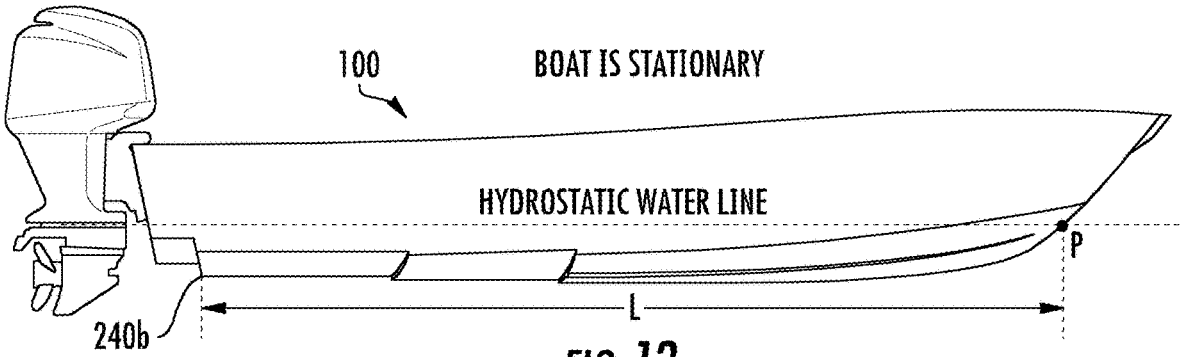
FIG. 13 is a starboard side plan view of the planing catamaran hull indicating the hydrostatic waterline when the boat is stationary.
Figure 14:
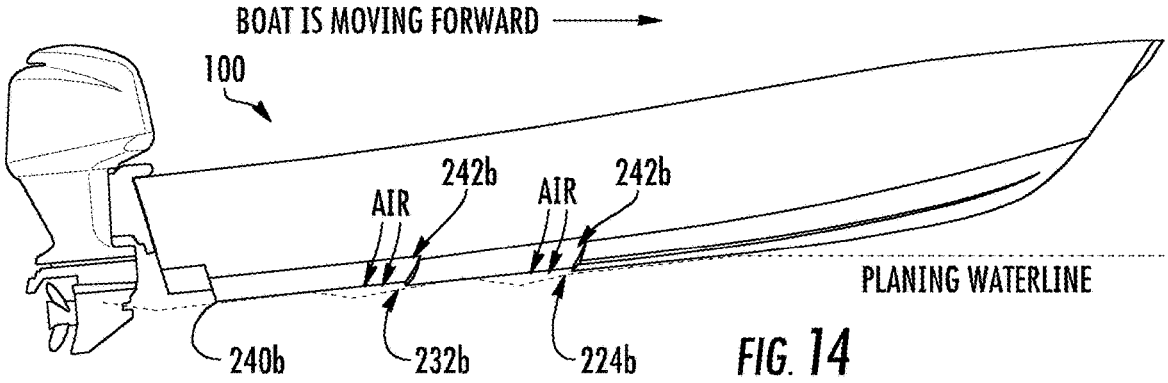
FIG. 14 is a starboard side plan view of the planing catamaran hull indicating the planing waterline when the boat is moving forward.
Figure 17:
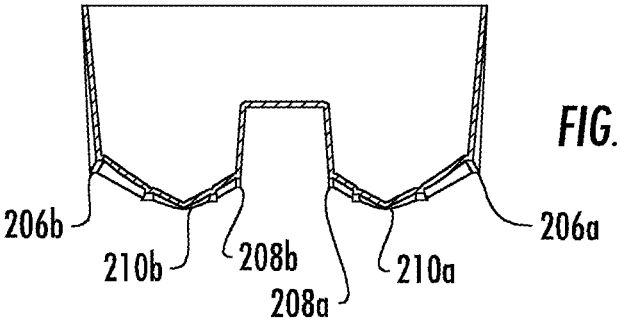
FIG. 17 is a cross-section of the hull taken along plane 17-17 of FIG. 11.
Figure 18:
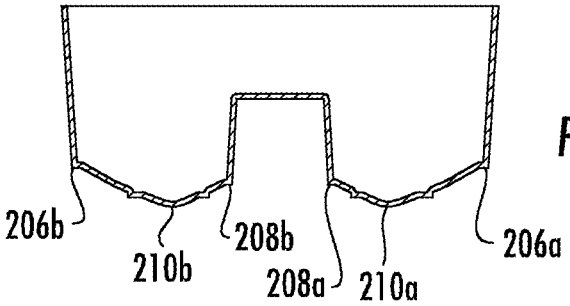
FIG. 18 is a cross-section of the hull taken along plane 18-18 of FIG. 11.
Figure 19:
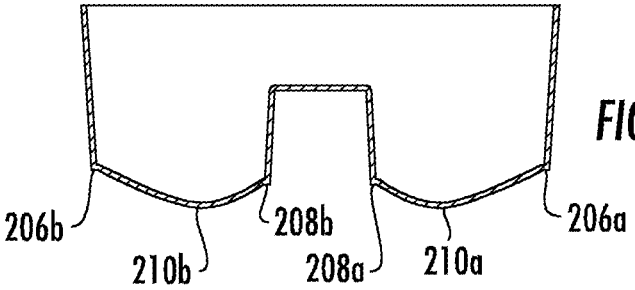
FIG. 19 is a cross-section of the hull taken along plane 19-19 of FIG. 11.
Figure 20:
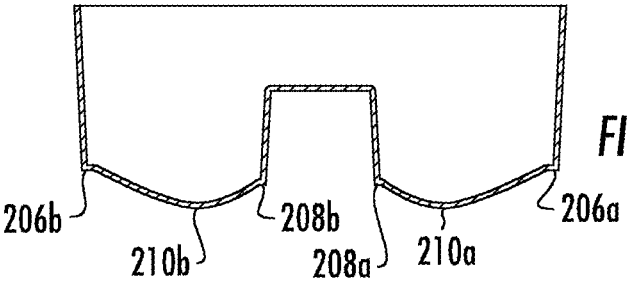
FIG. 20 is a cross-section of the hull taken along plane 20-20 of FIG. 11.

FIGS. 13 and 14 display the position of the waterline when the hull is stationary (FIG. 17) and planing (FIG. 18). In these figures the hull is shown with a motor. When the hull is planing, water flows past the steps and air enters from the sides of the steps and passes over the first running surface 230*a,b* and second running surface 230*b*, causing the water to lose contact with the underside 109. This produces lift and reduces drag aft steps 224*a,b* and 232*a,b*. When the catamaran is planing the running surface trailing edge 240*a,b* is where the water loses contact with the underside 109 of the hull. The running surface trailing edge 240*a,b*, therefore, defines the aft terminal end of the hull's running surface.

Ventilation ports 242*a,b* may be positioned at the forward edge of the steps 224*a,b* and 232*a,b* and above the planing waterline to provide a pathway for air to pass under the demi-hull 200*a,b* when the boat is planing. An alternative mechanism to provide airflow behind steps 224*a,b* and 232*a,b* may be to form a ventilation passage such as a hole that passes through the hull 100 and end at steps 224*a,b* and 232*a,b*.

The location of steps 224*a,b* and 232*a,b* may be adjusted for the desired performance. The step location is calculated relative to the position of the running surface trailing edge 240*a,b* and the point P, shown in FIG. 13. Point P is the position where the hydrostatic waterline intersects the bow end of the underside 109.

Figure 15:
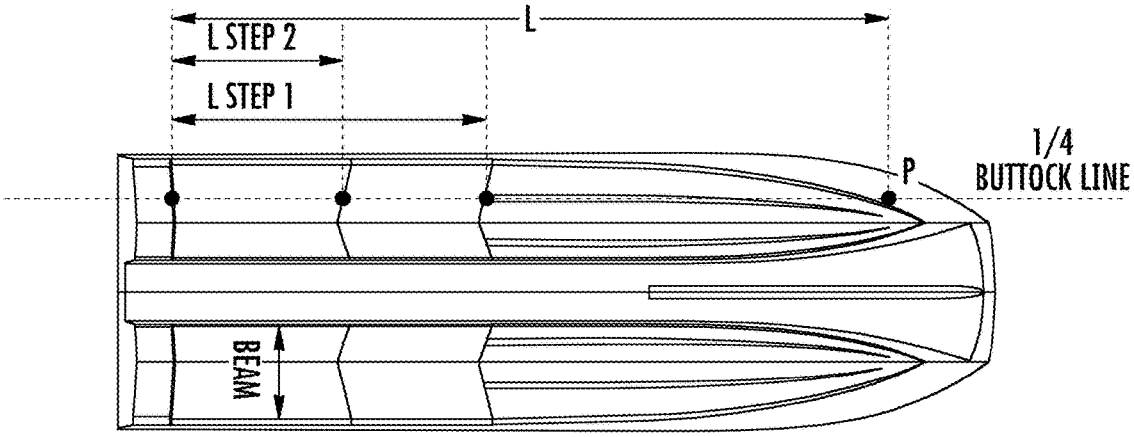
FIG. 15 is another bottom plan view of the hull providing reference measurement points.
Figure 16:
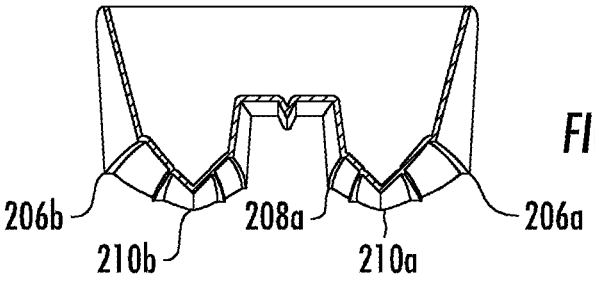
FIG. 16 is a cross-section of the hull taken along plane 16-16 of FIG. 11.

FIG. 15 shows reference measurements used to calculate the positions of the steps. For consistency, the measurements are made along the ¼ buttock line (shown in FIG. 15), which is a line defining a plane passing through the hull longitudinally at ¼ beam, which is the transverse location bisecting the keel line and the extent of the waterline beam at the midsection. L is the distance between point P and the aft end of the running surface. Lstep2 is the distance between the aft end of the running surface and the position at which the ¼ buttock line intersects the second step forward edge 234*a,b*. Lstep1 is the distance between the aft end of the running surface and the position at which the ¼ buttock line intersects the first step forward edge 226*a,b*.

The position of the steps is reported as a percentage of the distance L from the aft end of the running surface. Thus, the position of the first step 224*a,b* is Lstep1/L*100% and the position of the second step 232*a,b* is Lstep2/L*100%. Using these calculations, the position of the first step 224*a,b* may be 35%-50%, 38%-46%, or 38.6%-45.6%. In the example shown, the position of the first step 224*a,b* is about 42.1%. The position of the second step 232*a,b* is 15%-30%, 18%-27%, or 18.8%-26.8%. In the example shown, the position of the second step 232*a,b* is about 22.8%.

The depth of the steps 224*a,b* and 232*a,b* may also be adjusted for the desired performance. The depth of the steps 224*a,b* and 232*a,b* may be calculated relative to the demi-hull beam, which is the width of the demi-hull 200*a,b* at the hydrostatic water line. The first step 224*a,b* depth may be 1%-7% or 2%-6% of the beam. In the example shown, the first step 224*a,b* depth is about 4% of the beam. The second step 232*a,b* depth may be 1%-7% or 1%-5% of the beam. In the example shown, the second step 232*a,b* depth is 3% of the beam.

Figure 11:
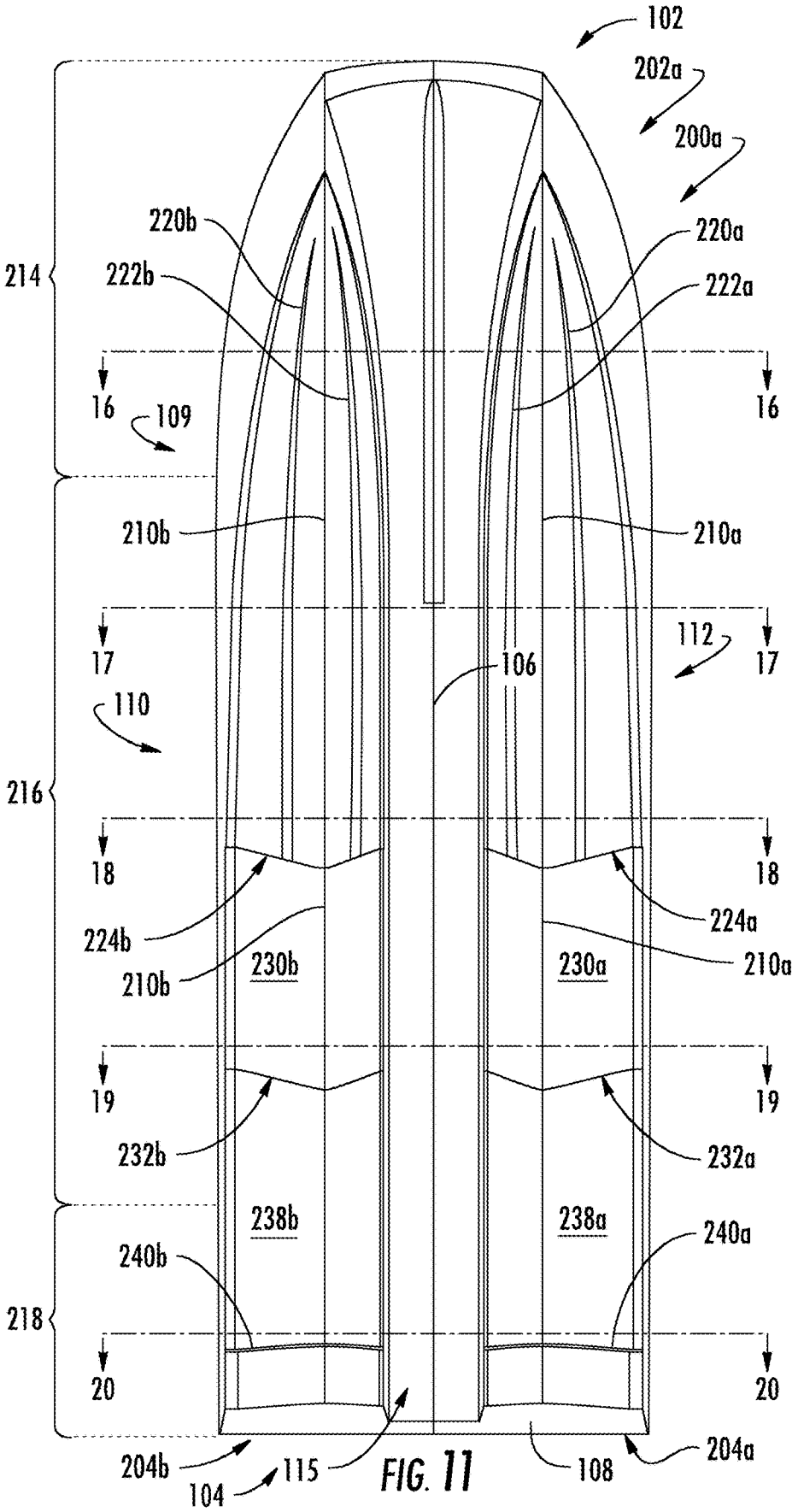
FIG. 11 is a bottom plan view thereof.
Figure 12:
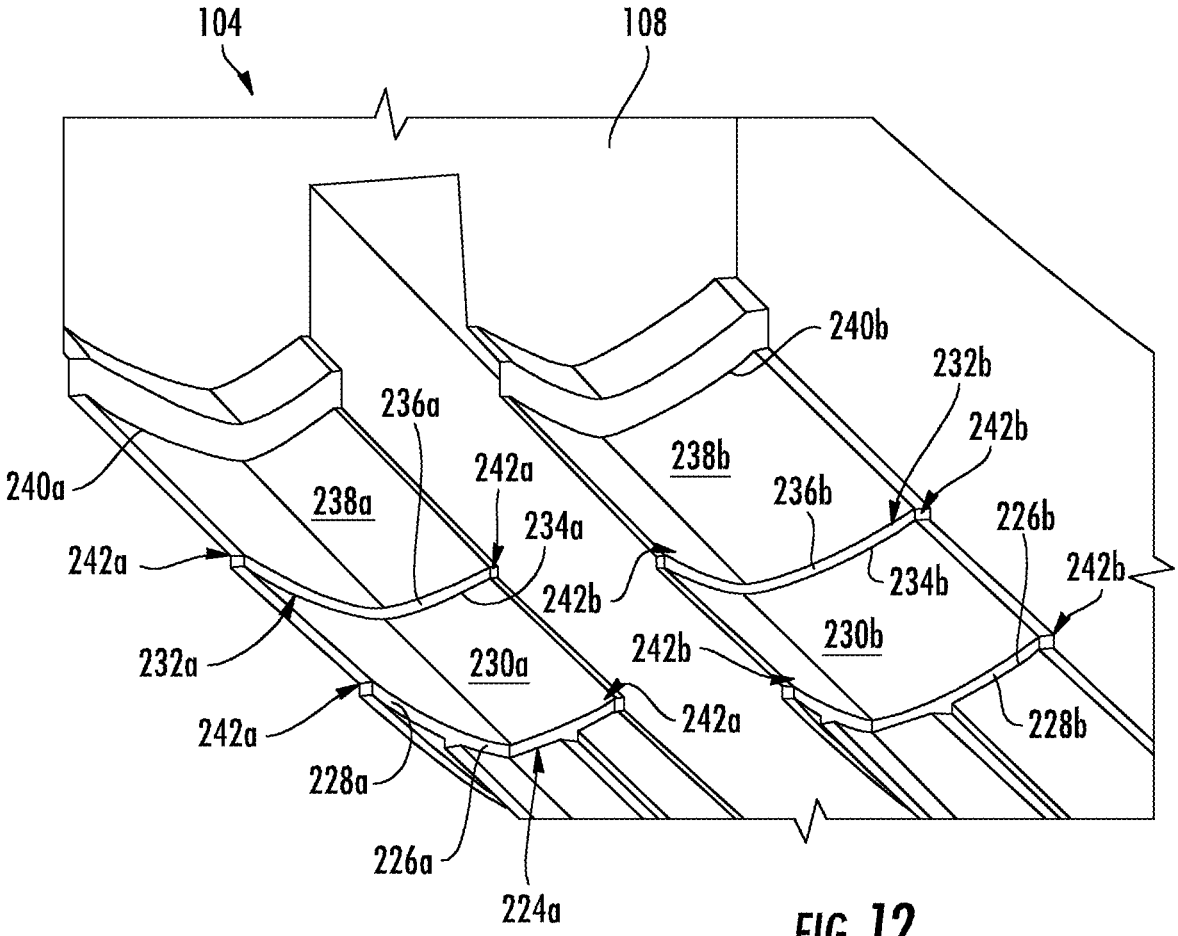
FIG. 12 is a close-up view of the underside of the hull illustrating features of the steps.

FIGS. 16-20 are cross-sections of the hull 100 taken along planes 16-16 through 20-20 of FIG. 11. These cross-sections display the demi-hull geometry at five different positions along the length of the hull. The demi-hull 100 geometry is semi-asymmetric and has unequal chine heights and substantially equal deadrise. Compared to the conventional semi-asymmetric demi-hulls shown in FIGS. 3 and 4, the shape of the running surface is different. The running surface, which is represented by the bottom of each demi-hull, has a convex curvature between the keel 210*a,b* and outer chine 206*a,b* and between the keel 210*a,b* and inner chine 208*a,b*. The convex shape provides improved motion and acceleration relative to conventional demi-hulls. Other examples of the demi-hulls may not include this convex curvature feature.

Figure 21:
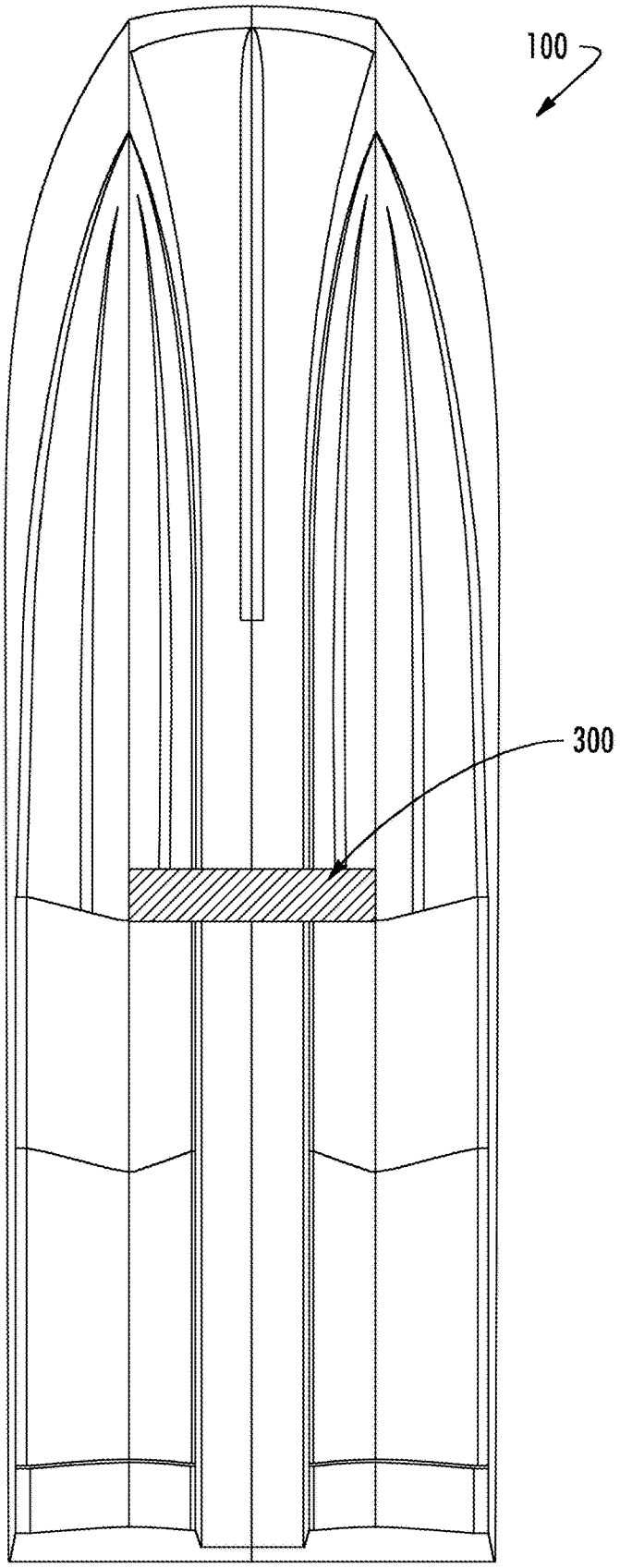
FIG. 21 is a bottom plan view of an example of the hull, including a hydrofoil.

Referring to FIG. 21, some examples of the hull 100 may include a hydrofoil 300. The hydrofoil may be located transversely between the two demi-hulls 200*a,b*. The hydrofoil 300 may be positioned proximate but forward the longitudinal center of gravity of the hull 100. The hydrofoil 300 is adapted to provide lift as water moves past it. The hydrofoil is positioned in the same longitudinal flow as the running surface and is influenced by the wake of the hull. The hydrofoil can achieve a greater Lift to Drag ratio than a planing surface and has the ability to mitigate vertical accelerations in waves.

The hull 100 may be equipped with an operator station including a steering mechanism and a throttle mechanism. The hull 100 may be powered by a conventional boat drive mechanism such as an outboard motor, jet drive, inboard motor, I/O motor, or the like.

Example

This section discusses the results of hydrodynamic computer simulations of the drag against the stepped catamaran hull described above compared to a non-stepped hull having substantially the same geometry. This example is provided for illustration purposes and does not limit the scope of the claims or possible embodiments in any way.

Figure 22:
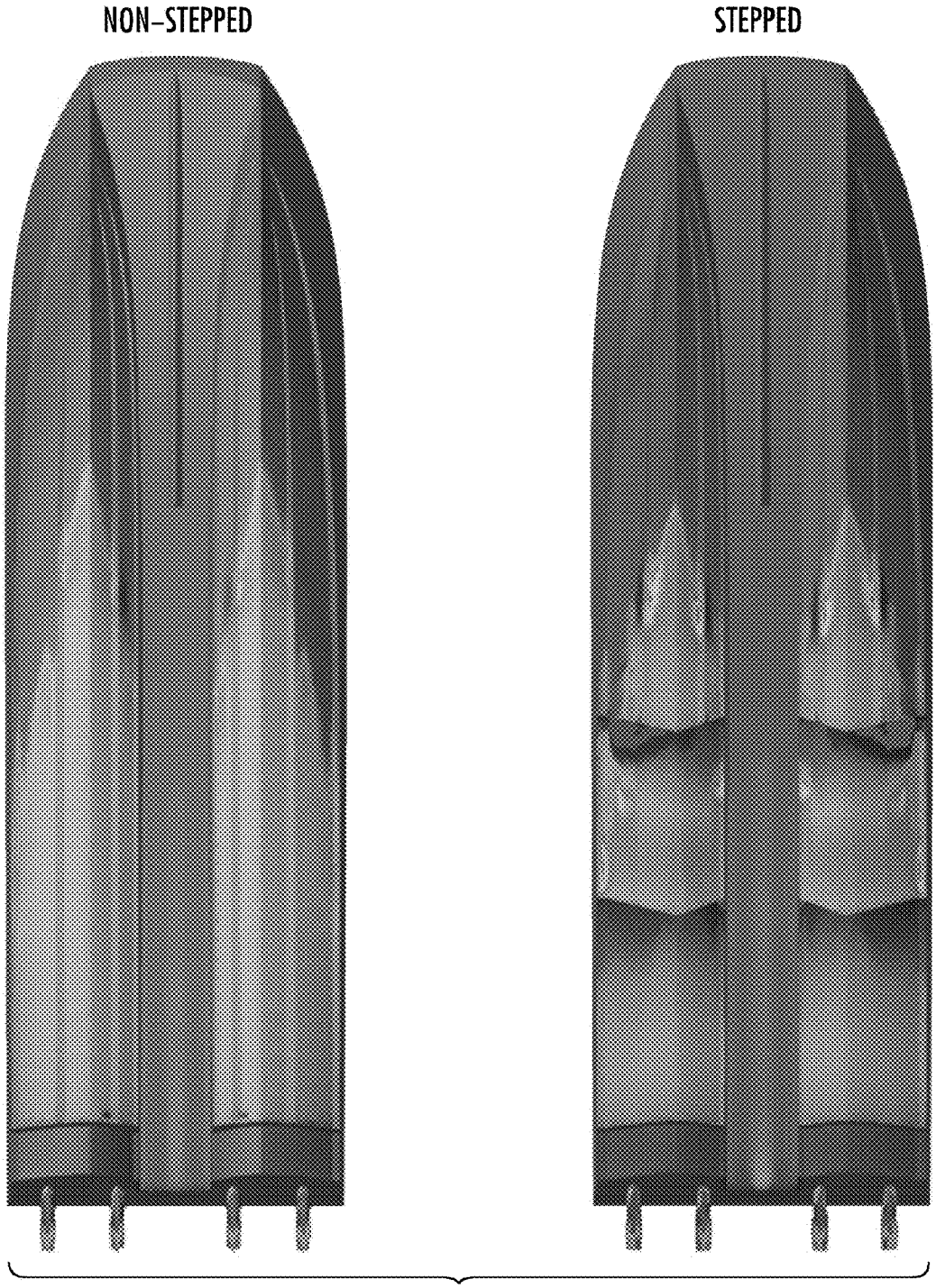
FIG. 22 is a bottom view of a non-stepped catamaran hull and a stepped catamaran hull showing pressure variations along the running surface calculated from a Computational Fluid Dynamics simulation.

Referring to FIG. 22, the results of the simulations are shown in terms of pressure. The scale goes from blue to red, with blue representing lower pressures and red representing higher pressures. For the non-stepped hull the pressure is primarily concentrated along the spray root line and slightly decreases moving aft.

For the stepped hull, the pressure is concentrated along different sections of the running surface. Aft the steps, the pressure decreases due to ventilation, then increases downstream as the separated flow reattaches to the hull bottom. This has two effects. First it reduces frictional drag, and second, it concentrates the dynamic pressure into multiple smaller high aspect ratio surfaces, as opposed to one low aspect ratio surface. Overall, this creates a slight increase pressure drag, but a greater relative loss in frictional drag, developing an overall lower drag and higher lift/drag ratio. This translates to overall less power required to achieve the same high speeds.

Figure 23:
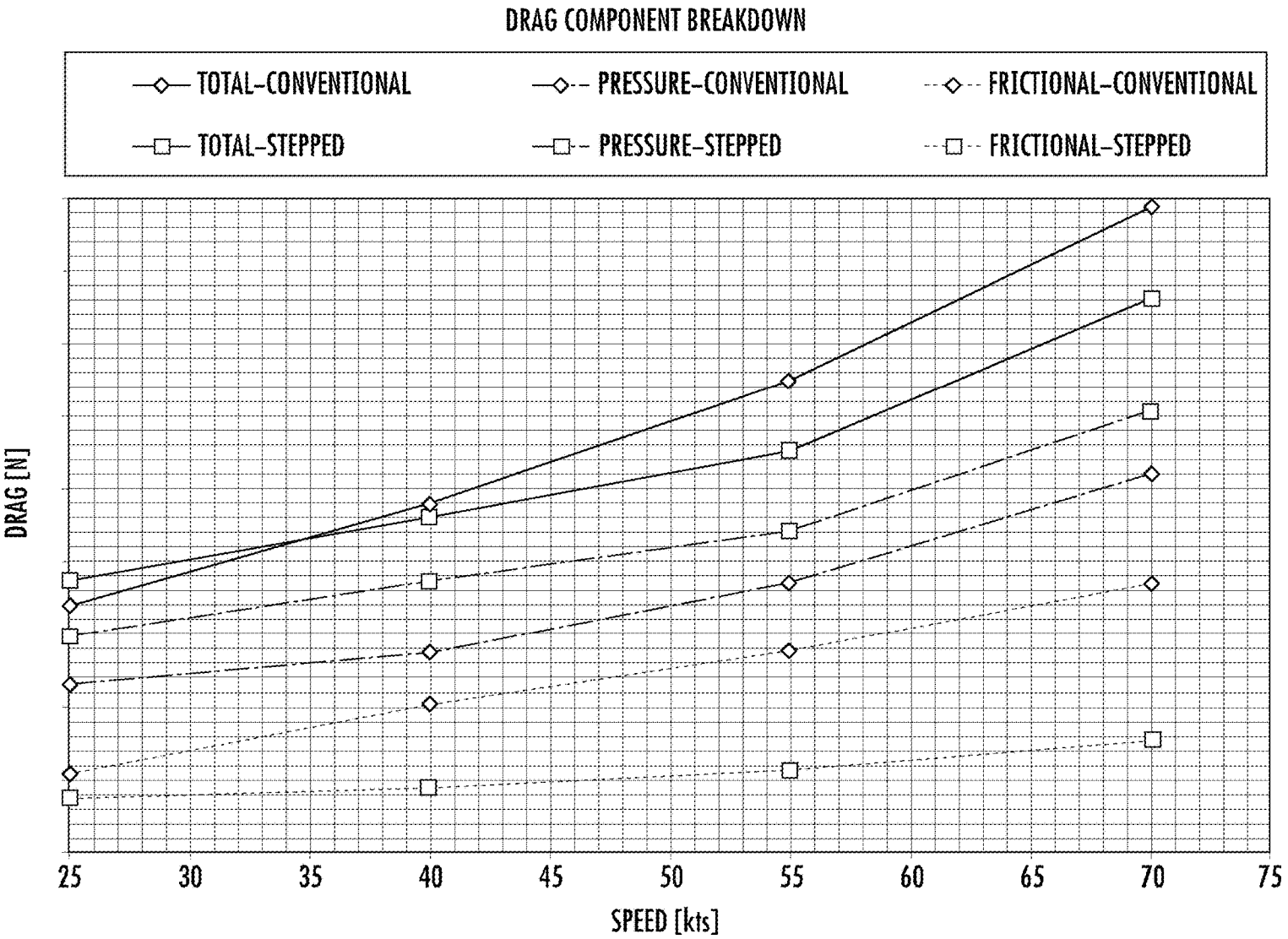
FIG. 23 is a line graph displaying the total drag and breakdown into the pressure drag and frictional drag components of the non-stepped and stepped catamaran hulls as a function of speed from the simulation.

FIG. 23 is a line graph displaying the total drag and breakdown into the pressure drag and frictional drag components of the non-stepped and stepped catamaran hulls as a function of speed from the simulation. At higher speeds, the total drag (pressure+frictional) on the stepped catamaran hull is significantly lower than the total drag on the non-stepped catamaran hull.

This disclosure has described certain examples and features of the catamaran in detail, but not all possible examples and features. The catamaran hull may be embodied in many different forms and is not limited only to the examples and features described here. Many modifications are possible without departing from the scope of the appended claims.

That which is claimed is:

1. A boat hull comprising:

a pair of demi-hulls, each demi-hull having:

a running surface configured to contact water when the hull is planing, the running surface extending longitudinally along a keel between an outer chine and an inner chine and aft to a running surface trailing edge, the running surface having 55% to 80% of its surface area outboard the keel;

a first step extending laterally across the running surface and between the outer chine and inner chine; and a first planing surface aft the first step along the running surface, the first planing surface having an outboard convex curved surface on an outboard side of the keel extending from the keel to the outer chine and an inboard convex curved surface on an inboard side of the keel extending from the keel to the inner chine.

2. The boat hull of claim 1, wherein the first step is positioned 38% to 46% of a distance forward the running surface trailing edge and a point where a hydrostatic waterline of the demi-hull intersects a bow end of the demi-hull measured along a ¼ buttock line of the demi-hull.

3. The boat hull of claim 1, wherein a depth of the first step is 2% to 6% of a beam of the demi-hull.

4. The boat hull of claim 1, wherein the first planing surface is strakeless.

5. The boat hull of claim 1, further comprising:

a second step aft the first planing surface, the second step extending laterally across the running surface and between the outer chine and inner chine; and a second planing surface aft the second step along the running surface, the second planing surface having an outboard convex curved surface on an outboard side of the keel extending from the keel to the outer chine and an inboard convex curved surface on an inboard side of the keel extending from the keel to the inner chine.

6. The boat hull of claim 5, wherein the second step is positioned 18% to 27% of a distance forward the running surface trailing edge and a point where a hydrostatic waterline of the demi-hull intersects a bow end of the demi-hull measured along a ¼ buttock line of the demi-hull.

7. The boat hull of claim 5, wherein a depth of the second step is 1% to 5% of a beam of the demi-hull.

8. The boat hull of claim 5, wherein the second planing surface is strakeless.

9. The boat hull of claim 1, wherein the demi-hull has an unequal chine height and substantially equal deadrise angle on either side of the keel.

10. The boat hull of claim 1, further comprising a hydrofoil positioned between the demihulls.

11. The boat hull of claim 1 on a boat including a boat drive mechanism.

12. A boat hull comprising a pair of demi-hulls, the demi-hulls respectively having:

a running surface configured to contact water when the hull is planing, the running surface extending longitudinally along a keel between an outer chine and an inner chine, the running surface having an aft terminal edge and an intersection point where a hydrostatic waterline of the demi-hull intersects a bow section of the demi-hull;

a first step extending laterally across the running surface and between the outer chine and inner chine, the first step being positioned 38% to 46% of a distance forward the aft terminal edge and the intersection point measured along a ¼ buttock line of the demi-hull; and a second step extending laterally across the running surface and between the outer chine and inner chine, the second step being positioned 18% to 27% of the distance forward the aft terminal edge and the intersection point measured along the ¼ buttock line of the demi-hull.

13. The boat hull of claim 12, wherein the running surface has 55% to 80% of its surface area outboard the keel.

14. The boat hull of claim 12, further comprising a first planing surface aft the first step along the running surface, the first planing surface having an outboard convex curved surface on an outboard side of the keel extending from the keel to the outer chine and an inboard convex curved surface on an inboard side of the keel extending from the keel to the inner chine; and a second planing surface aft the first step along the running surface, the second planing surface having an outboard convex curved surface on an outboard side of the keel extending from the keel to the outer chine and an inboard convex curved surface on an inboard side of the keel extending from the keel to the inner chine.

15. The boat hull of claim 14, wherein the first planing surface is strakeless and the second planing surface is strakeless.

16. The boat hull of claim 12, wherein the demi-hull has an unequal chine height and substantially equal deadrise angle on either side of the keel.

17. The boat hull of claim 12, wherein a depth of the first step is 2% to 6% of a beam of the demi-hull and a depth of the second step is 1% to 5% of a beam of the demi-hull.

18. The boat hull of claim 12, further comprising a hydrofoil positioned between the demihulls.

19. The boat hull of claim 12 on a boat including a boat drive mechanism.

* * * * *